United States Patent [19]

Losa et al.

[11] Patent Number: 4,579,063

[45] Date of Patent: Apr. 1, 1986

[54] INTER-CARRIAGE COMMUNICATION PASSAGE FOR RAIL OR TRAMWAY VEHICLES

[75] Inventors: Pier A. Losa, Pianezza; Francesco Fantini, Turin, both of Italy

[73] Assignee: Fiat Ferroviaria Saviglino S.p.A., Turin, Italy

[21] Appl. No.: 708,257

[22] Filed: Mar. 5, 1985

[30] Foreign Application Priority Data

Nov. 7, 1984 [IT] Italy ..... 68110 A/84

[51] Int. Cl.[4] ..... B61D 17/20

[52] U.S. Cl. ..... 105/4 R; 105/8 R; 280/403

[58] Field of Search ..... 105/1 A, 3, 4 R, 4 A, 105/8 R, 9; 280/403

[56] References Cited

U.S. PATENT DOCUMENTS 2,268,318 12/1941 Urbinati ..... 105/4 R
3,513,592 7/1967 Ernst ..... 105/4 R X

FOREIGN PATENT DOCUMENTS 528157 8/1979 Fed. Rep. of Germany ..... 105/3
466713 5/1937 United Kingdom ..... 105/4 R

*Primary Examiner*—Robert B. Reeves
*Assistant Examiner*—Glenn B. Foster
*Attorney, Agent, or Firm*—McCormick, Paulding & Huber

[57] ABSTRACT

An inter-carriage communication passage between the bodies of two carriages of a rail or tramway vehicle of the kind having respective articulation ends articulated to a single bogie. The passage includes two end plates resting in a swivellable manner on the articulation ends of the bodies and articulated to the structure of the bogie and a central plate formed by two independent triangular half-plates hinged to the two end plates, so that the passage can adapt to the different configurations which the bogie may assume as it passes over track irregularities.

4 Claims, 4 Drawing Figures

INTER-CARRIAGE COMMUNICATION PASSAGE FOR RAIL OR TRAMWAY VEHICLES

The present invention relates in general to rail or tramway vehicles including two carriages the bodies of which communicate with each other through an intercommunication passage and in which the two bodies have respective articulation ends articulated to the structure of a single bogie located beneath the intercommunication passage.

The object of the present invention is to provide an intercommunication passage shaped so as to allow it to adapt as completely as possible to the different configurations which the bogie may assume as it passes over crooked and irregular track, at the same time allowing the best possible use of the space for passengers in the passageway between the bodies of the two carriages.

In order to achieve this object, the present invention provides an intercommunication passage of the type defined at the beginning, characterised in that it includes a platform interposed between the floors of the two bodies including:

first and second end plates with semi-circular end profiles facing complementary parts of the floors of the two bodies, each of the two end plates resting in a swivellable manner on the articulation end of the respective body, articulation means interconnecting the structure of the bogie and the facing ends of the two end plates of the platform and a central substantially rectangular plate extending between the two end plates and divided diagonally into two independent half-plates having a right angled triangle shape each of which has one side hinged to one of the end plates (12, 14) and its vertex opposite this side hinged to the other of the two end plates.

According to the invention, each of the end plates rests on the articulation end of the respective body by means of three spherical bearers of which one is located in correspondence with the joint between this articulation end and the structure of the bogie and the other two are movable along longitudinal slide guides carried by the articulation end of the body.

The intercommunication passage according to the invention affords a wide and spacious passage for passengers, while at the same time allowing the necessary relative movements between the two bodies and between these and the bogie, as well as twisting of the components of the bogie itself to allow it to adapt to irregularities in the track.

Figure 1:
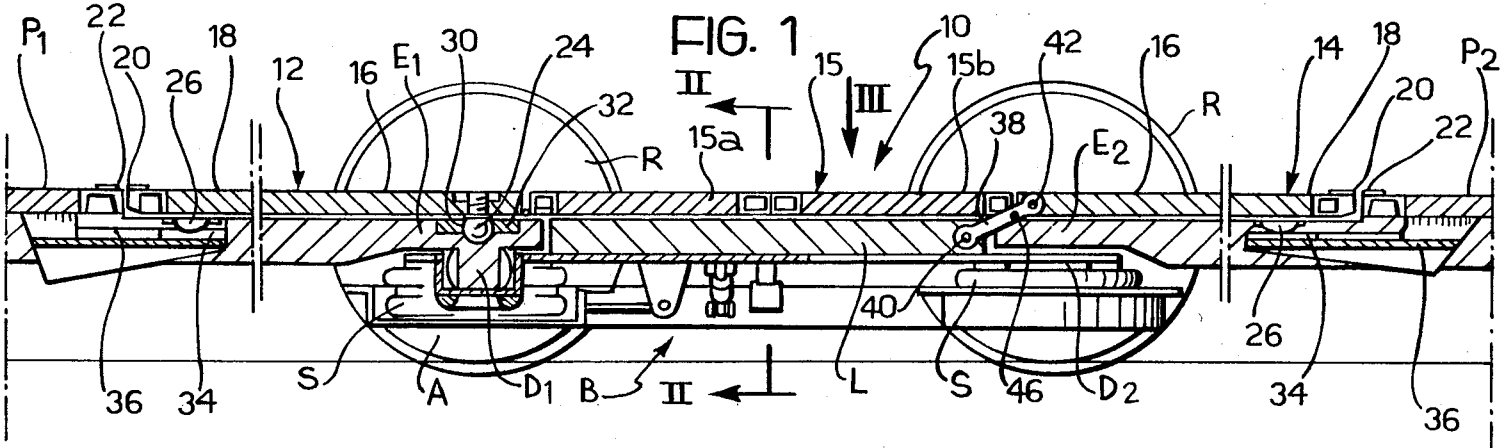
Figure 2:
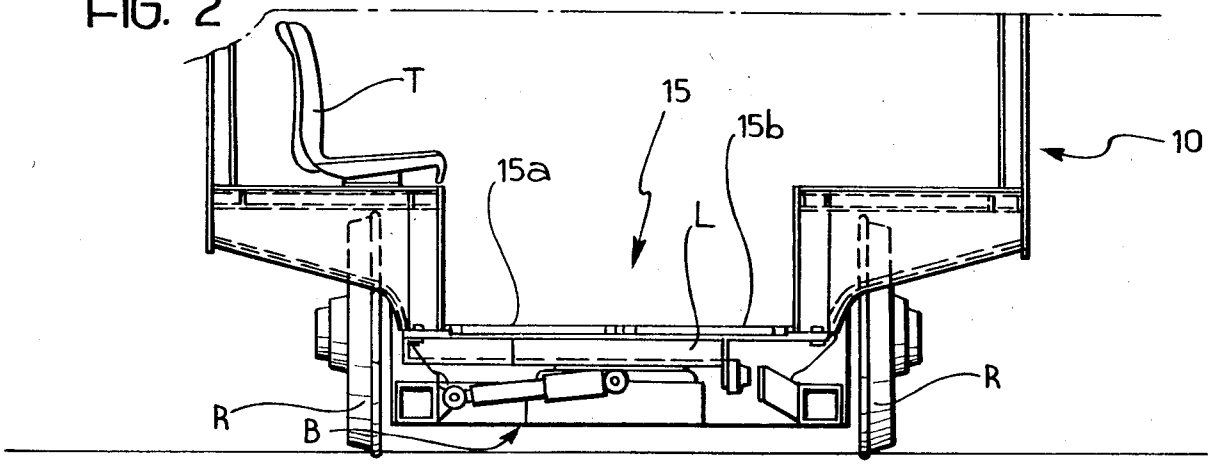
Figure 3:
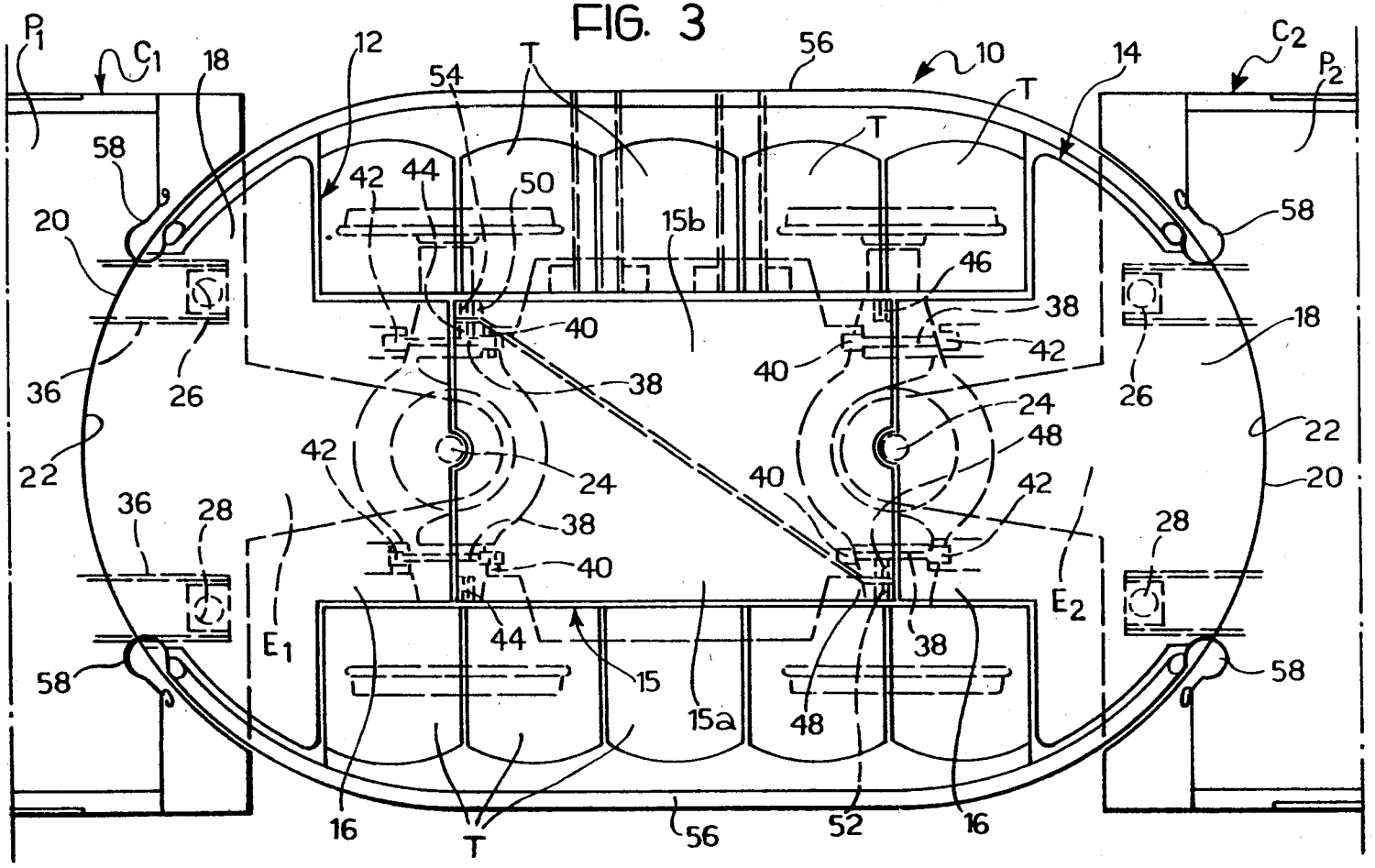
Figure 4:
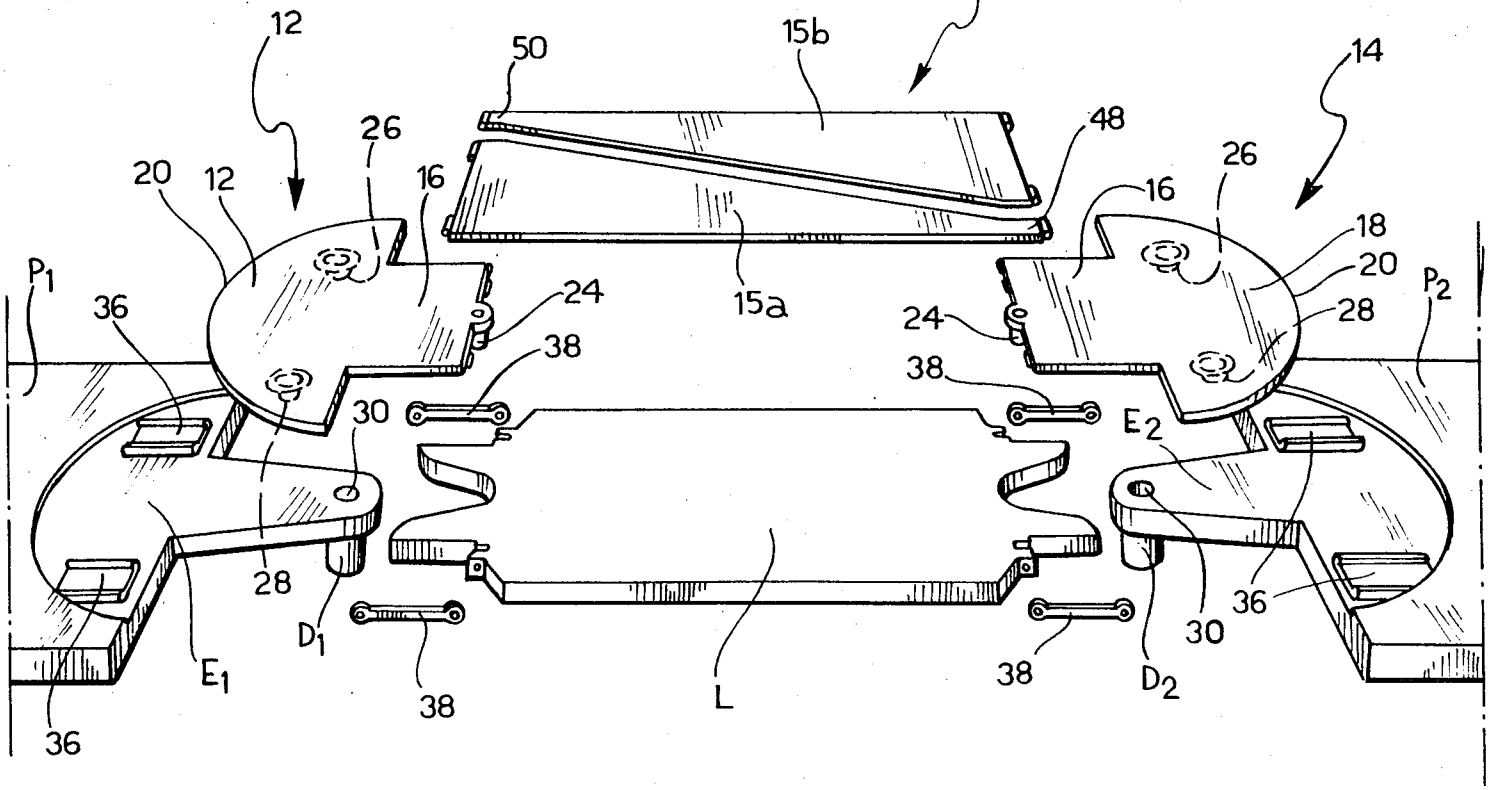

The invention will now be described in detail with reference to the appended drawings, provided purely by way of non-limiting example, in which:

FIG. 1 is a partially sectioned longitudinal schematic view of part of a rail or tramway vehicle having an intercommunication passage according to the invention, FIG. 2 is a partially sectioned schematic view taken on the line II—II of FIG. 1, FIG. 3 is a plan view from above taken on the arrow III of FIG. 1, and FIG. 4 is an exploded perspective view of the essential components of the intercommunication passage according to the invention.

Referring to the drawings, two carriages of a rail or tramway vehicle $C_1$ and $C_2$ are articulated together through a central intercommunication passage 10.

The floors of the two bodies, indicated $P_1$ and $P_2$, have respective tapered ends $E_1$, $E_2$, articulated to a central bogie B located beneath the intercommunication passage 10. The bogie B, which is, for example of the type described and illustrated in the copending Italian patent application No. 68091-A/84, is of the double axle type carrying idle wheels R capable of a wide range of relative movements in a vertical sense.

The bogie B will not be described in detail: for the purposes of the present invention it suffices to say that the two axles carry at their centres two central springs of the flexible bellows pneumatic type S on which rests a central longitudinal structure L carrying at its ends two ball joint coupling members A within which are engaged respective articulation pins $D_1$, $D_2$ projecting downwardly from the articulation ends $E_1$, $E_2$ of the floors $P_1$, $P_2$ of the two bodies.

The intercommunication passage 10 is formed by a platform including two end plates 12, 14 and an intermediate plate 15 which extends between the end plates 12 and 14.

Each end plate 12, 14 has an T-shape in plan with a rounded head. In effect each plate comprises an inner rectangular portion 16 which is connected to an enlarged part in the form of a circular sector 18 the rounded edge 20 of which faces a complementary rounded edge 22 of the floor $P_1$, $P_2$ of the respective body $C_1$, $C_2$.

Each plate 12, 14 rests in a swivellable manner on the corresponding articulation end $E_1$, $E_2$ by means of three spherical bearers 24, 26, 28 disposed at the vertices of an isoceles triangle. In particular, the bearer 24 is located in correspondence with the central part of the base side of the portion 16 and engages rotatably in a seat 30 formed in the end $E_1$, $E_2$ respectively in alignment with the axis of the articulation pin $D_1$, $D_2$. The spherical bearer 24 is retained in the seat 30 by means of a locking ring 32.

The bearers 26 and 28 are in fact constituted by hemispherical elements which bear on respective slides 34 movable along guides 36 carried by the ends $E_1$, $E_2$ respectively and extending parallel to the longitudinal axes of the bodies $C_1$, $C_2$.

The portion 16 of each plate 12 is also connected to the longitudinal structure L of the bogie B by means of a pair of longitudinal connecting rods 38 through ball joints generally indicated 40, 42.

The intermediate plate 15 has a generally rectangular shape and is interposed between the base sides of the portions 16 of the two end plates 12 and 14. In fact the plate 15 is divided diagonally into two independent half plates **15*a*, 15*b* each generally in the form of a right angled triangle. They are separated along their respective hypotenuses while the respective catheti facing the plates 12 and 14 are articulated to the portions 16 thereof by means of hinges 44, 46** the axes of which are arranged transverse the longitudinal axis of the vehicle.

The vertices of the half-plates **15*a*, 15*b* opposite the hinges 44, 46 have respective appendages 48, 50 articulated to the portion 16 of the other plate 14 and 12 respectively by means of hinges 52, 54 similar to the hinges 44 and 46**.

The intercommunication passage 10 is completed by two side walls 56 and a roof (not illustrated) as well as flexible closure members 58 interconnecting the ends of the side walls 56 and the walls of the two bodies $C_1$, $C_2$.

As is best seen in FIG. 2, the plates 12, 14 and 15 define a recessed standing platform at the sides of which, within the intercommunication passage 10, are provided two raised rows of seats T. By virtue of the configuration described above, the standing platform is able to adapt perfectly to any relative movement between the bodies $C_1$, $C_2$, between the bodies and the bogie B and between the wheels R of the bogie during travel over crooked or irregular track, while at the same time ensuring convenient and easy movement of passengers between the two bodies.

Naturally, the principle of the invention remaining the same, constructional details and embodiments may be varied widely with respect to that described and illustrated without thereby departing from the scope of the present invention.

We claim:

1. Intercommunication passage between the bodies of two carriages of a rail or tramway vehicle having respective floors and respective articulation ends and a single bogie articulated to said ends, the intercommunication passage having a platform interposed between said floors above said bogie, said platform including, in combination:

first and second end plates with respective facing inner ends and respective semi-circular outer end profiles each of said inner ends being of a rectangular configuration oriented in the same plane as the outer ends, said outer ends of said end plates facing mating portions of the floors of the two bodies, and swivelably resting on the articulated ends of the respective bodies, articulation means interconnecting the bogie and the facing inner ends of the two end plates and a central substantially rectangular plate extending between the two end plates and comprising two independent half-plates oriented in the same plane, each having the general shape of a substantially right-angled triangle with the hypotenuse of the two triangles facing each other, each of said end plates being hinged to the vertix of one of said triangles, and the base of the other of said triangles.

2. The intercommunication passage defined in claim 1, wherein each of the two end plates has bearing means by which it rests on the articulation end of the respective body, said bearing means comprising three spherical bearers located at the vertices of an isosceles triangle one of which bearers is located in correspondence with the joint between said articulation end and the bogie, there being further provided longitudinal slide guides carried by said articulation end for guiding movement of the other two said bearers longitudinally.

3. The intercommunication passage defined in claim 1, wherein the articulation means include two pairs of longitudinal connecting rods having ball joints connecting one end to the bogie and the other end to the end plates.

4. Rail or tramway vehicle including two articulated carriages and an intercommunication passage through which the bodies of the carriages communicate with each other, the carriages having respective floors and respective articulation ends and a single bogie located beneath the intercommunication passage and articulated to said articulation ends, wherein the intercommunication passage has a platform including, in combination:

first and second end plates with respective facing inner ends and respective semi-circular outer end profiles each of said inner ends being of a rectangular configuration oriented in the same plane as the outer ends, said outer ends of said end plates facing mating portions of the floors of the two bodies, and swivelably resting on the articulated ends of the respective bodies, articulation means interconnecting the bogie and the facing inner ends of the two end plates and a central substantially rectangular plate extending between the two end plates and comprising two independent half-plates oriented in the same plane, each having the general shape of a substantially right-angled triangle with the hypotenuse of the two triangles facing each other, each of said end plates being hinged to the vertix of one of said triangles, and the base of the other of said triangles.

* * * * *